US006378947B1

(12) United States Patent
Barber et al.

(10) Patent No.: US 6,378,947 B1
(45) Date of Patent: Apr. 30, 2002

(54) SEATING SYSTEM

(75) Inventors: Alan Barber; Michael Doell, both of Toronto; Stephen Ryan, Mississauga; Ihsan Al-Temen, Richmond Hill; Patricia Rigby, Toronto, all of (CA)

(73) Assignee: Bloorview MacMillan Centre, Toronto (CA)

( * ) Notice: Subject to any disclaimer, the term of this patent is extended or adjusted under 35 U.S.C. 154(b) by 0 days.

(21) Appl. No.: 09/546,679

(22) Filed: Apr. 11, 2000

Related U.S. Application Data

(60) Provisional application No. 60/128,808, filed on Apr. 12, 1999.

(51) Int. Cl.[7] ..... A47C 7/02

(52) U.S. Cl. ..... 297/452.25; 297/130; 297/256.16; 297/284.7; 297/284.9; 297/344.1; 297/353; 297/362.14; 297/440.22; 297/466; 297/488; 297/DIG. 4

(58) Field of Search ..... 297/130, 256.16, 297/284.7, 284.9, 344.1, 353, 362.14, 440.22, 452.25, 466, 488

(56) References Cited

U.S. PATENT DOCUMENTS 186,957 A * 2/1877 Roy ..... 297/320
1,527,754 A * 2/1925 Simon ..... 601/24
2,572,149 A * 10/1951 Hind et al. ..... 280/290
3,007,738 A * 11/1961 Gardel etf al. ..... 297/423.2
3,050,741 A * 8/1962 Coleman ..... 4/480
3,269,482 A * 8/1966 McCarthy, Jr. ..... 180/268
3,316,018 A * 4/1967 Stith ..... 297/440.1
3,409,326 A * 11/1968 Kerner ..... 280/753
3,764,180 A * 10/1973 Mulholland ..... 297/400
3,815,586 A 6/1974 Kazik
3,917,312 A * 11/1975 Rodaway ..... 280/250.1
3,950,026 A * 4/1976 Van Seenus ..... 297/328
4,065,179 A * 12/1977 Takasaki ..... 297/464
4,073,537 A 2/1978 Hammersburg
4,170,368 A * 10/1979 Southward et al. ..... 280/250.1
4,386,803 A * 6/1983 Gilderbloom ..... 297/84
4,493,488 A * 1/1985 Panaia et al. ..... 280/42
4,579,191 A * 4/1986 Klee et al. ..... 180/268
4,588,229 A 5/1986 Jay
4,617,919 A 10/1986 Suhre
4,629,246 A * 12/1986 Fulton ..... 297/44
4,660,238 A 4/1987 Jay
4,726,624 A 2/1988 Jay
4,753,480 A * 6/1988 Morell ..... 297/452
4,761,843 A 8/1988 Jay
4,813,746 A 3/1989 Mulholland
4,842,330 A 6/1989 Jay
4,861,105 A * 8/1989 Merten et al. ..... 297/250
4,915,447 A * 4/1990 Shovar ..... 297/284
5,018,790 A 5/1991 Jay
5,062,677 A 11/1991 Jay et al.
5,074,620 A 12/1991 Jay et al.
5,149,173 A 9/1992 Jay et al.
5,201,780 A 4/1993 Dinsmoor, III et al.
5,211,446 A 5/1993 Jay et al.
5,228,747 A 7/1993 Greene
5,255,404 A 10/1993 Dinsmoor, III et al.
5,300,071 A 4/1994 Browner et al.
5,303,436 A 4/1994 Dinsmoor, III et al.
5,333,921 A 8/1994 Dinsmoor, III (List continued on next page.)

*Primary Examiner*—Peter M. Cuomo
*Assistant Examiner*—Joseph Edell
(74) *Attorney, Agent, or Firm*—Bereskin & Parr

(57) ABSTRACT

A seating system, for example a paediatric seating system for wheelchairs, provides appropriate support for a person using the chair by providing adjustable components to support specific anatomical areas of the back, pelvis and upper leg and, more specifically, three components that stabilize the pelvis of that person. These components comprise an elevation change in the seat, a pad at the back that provides resistance to the posterior superior iliac spine (PSIS) and a pair of anterior pelvic pads that stabilize below the anterior superior iliac spine (ASIS).

8 Claims, 7 Drawing Sheets

U.S. PATENT DOCUMENTS 5,340,139 A 8/1994 Davis
5,352,023 A 10/1994 Jay et al.
5,362,543 A 11/1994 Nickerson
5,366,277 A 11/1994 Tremblay
5,369,829 A 12/1994 Jay
5,390,384 A 2/1995 Dinsmoor, III et al.
5,395,162 A 3/1995 Jay et al.
5,397,517 A 3/1995 Jay et al.
5,447,356 A * 9/1995 Snijders ..... 297/284.3
5,457,833 A 10/1995 Jay
5,490,299 A 2/1996 Dinsmoor, III et al.
5,524,971 A 6/1996 Jay et al.
5,556,163 A * 9/1996 Rogers, III et al. ..... 297/330
5,556,168 A 9/1996 Dinsmoor, III et al.
5,592,707 A 1/1997 Dinsmoor, III et al.
5,593,211 A 1/1997 Jay et al.
5,647,637 A 7/1997 Jay et al.
5,671,977 A 9/1997 Jay et al.
5,678,798 A * 10/1997 Little ..... 248/289.11
5,683,201 A * 11/1997 Guaron ..... 403/325
5,687,436 A 11/1997 Denton
5,730,498 A 3/1998 Hanson et al.
5,857,749 A 1/1999 DeBellis et al.
5,947,562 A * 9/1999 Christofferson et al. ..... 297/440.22
6,213,558 B1 * 4/2001 Axelson et al. ..... 297/464

* cited by examiner

FIG. 4.
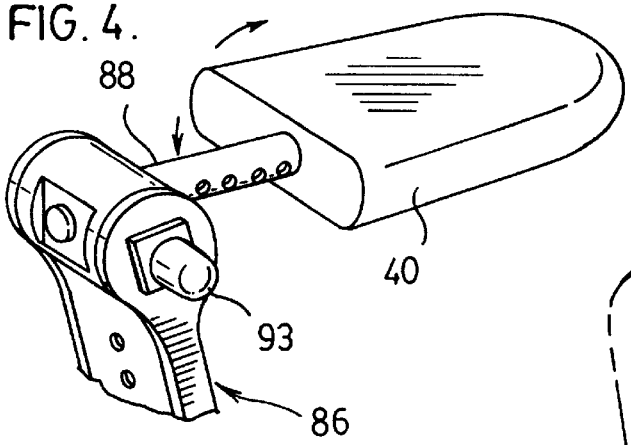
FIG. 5.
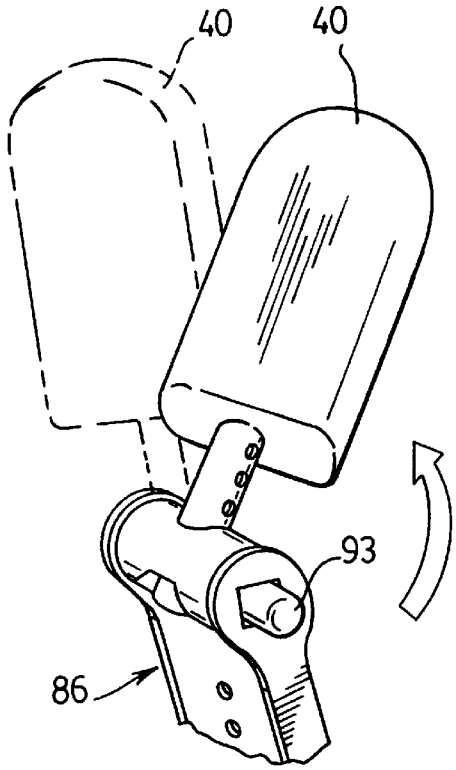
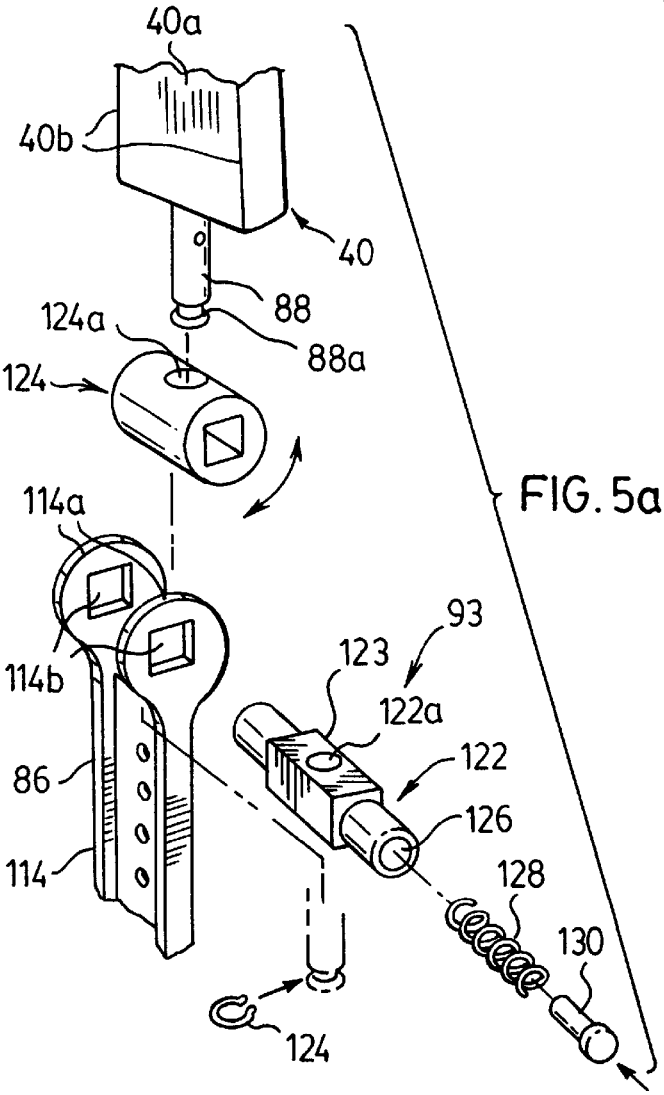
FIG. 5a.

SEATING SYSTEM

CROSS-REFERENCE TO RELATED APPLICATIONS

This application claims benefit from United States provisional application Ser. No. 60/128,808 filed Apr. 12, 1999 which is incorporated herein by reference in its entirety.

FIELD OF THE INVENTION

This invention relates generally to seating systems, for example for wheelchairs. The invention may also have application to other seating systems that call for a person using a seat to be provided with precise postural control during conditions that may hamper stability of seated position. Examples of such applications are seating systems for heavy equipment, such as logging or earth-moving equipment or for surgeons carrying out specialized types of surgery.

BACKGROUND OF THE INVENTION

Broadly speaking, the invention seeks to address postural support problems for people of all ages. However, the invention has been devised primarily in the context of pediatric seating systems for wheelchairs. So-called "adaptive" seating systems play an important role in the lives of many children with physical disabilities. These systems help keep children comfortable and secure while they are in their wheelchairs. Seating systems make it easier for them to breathe, eat and communicate. In North America, it is estimated that about 40,000 children between the ages of five and twelve have moderate-to-severe seating problems and need special wheelchair seating systems.

Finding an appropriate wheelchair seating system for elementary school-age children with positioning problems is challenging for families. Modular, "out-of-the-box" wheelchair seats often do not provide sufficient adjustment to position many children with disabilities. Alternatively, custom wheelchair seats can be designed, constructed and fit so children get the support they need for everyday activities. However, custom seating systems are expensive, require specialized seating teams to produce them, and are difficult to adapt for daily activities and growth.

SUMMARY OF THE INVENTION

The present invention provides a seating system which includes at least seat and back components that are adjustable to provide individualized posture control for a person using the seating system. Preferably, the seating system includes first, second and third pelvic stabilization components, namely:

(1) a raised barrier that extends transversely of the seat at a distance spaced forwardly of a rear end of the seat for co-operating with the ischial tuberosities of the pelvis to control rotation of the pelvis beneath the person;

(2) a pad extending transversely of the back at a location to provide resistance to the posterior superior iliac spine (PSIS) of the pelvis; and, (3) means extending transversely of and spaced above the seat in the vicinity of the upper thigh area of the person, for controlling anterior and rotational movement of the pelvis.

In summary, it has been discovered that precise upper body control may be achieved by providing a seating system that has the three pelvic stabilization components referred to previously, for co-operating with, respectively, the ischial tuberosities, the PSIS, and the frontal pelvic area of the person. In practice, the latter component may comprise one or more pads that are in the vicinity of the upper thighs (as well underlying muscle tissue and sinew), beneath the anterior superior iliac spine (ASIS) of the pelvis. In this context, it is understood that the superior iliac spine continues around the top, front and back of the pelvis and provides anterior and posterior stabilization areas for the pads.

The description which follows includes additional features of the seating system of the invention that may be used together or individually, in combination with the three pelvic stabilization components identified previously.

As noted above, the invention has been devised primarily in the context of paediatric seating systems for wheelchairs. Accordingly, the description and the accompanying drawings refer to this particular application of the invention by way of example and without limitation. The acronym MPS is used to refer to the inventive "Modular Paediatric Seating" system.

BRIEF DESCRIPTION OF DRAWINGS

FIGS. 4 and 5 are perspective views illustrating Anterior Pelvic Stabilizer (APS) pads that form part of the seating system, and show the pads in alternative positions;

FIG. 5*a* is an exploded perspective view of the. mechanism shown in FIGS. 4 and 5;

DESCRIPTION OF PREFERRED EMBODIMENT

The MPS system is a wheelchair seating system that can adapt to meet the unique positioning needs of school-age children with physical disabilities. Intended users of this product include six-to-twelve year old children with cerebral palsy who have moderate seating problems, mild fixed skeletal deformities, mild primitive reflexes, and mild-to-moderate hypotonicity.

Figure 1:
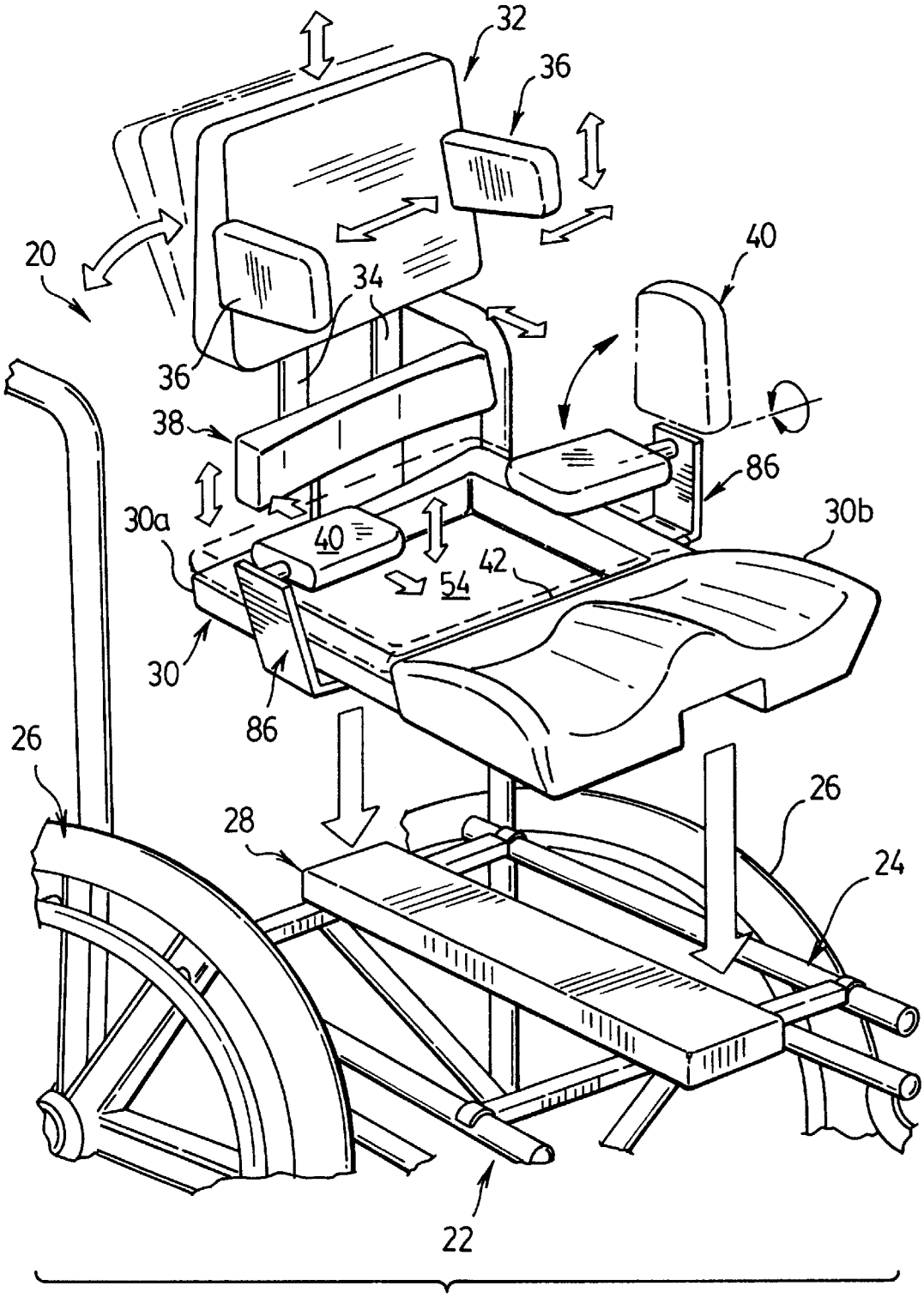
FIG. 1 is a partly exploded perspective view of a seating system for a wheelchair in accordance with a preferred embodiment of the invention.
Figure 3:
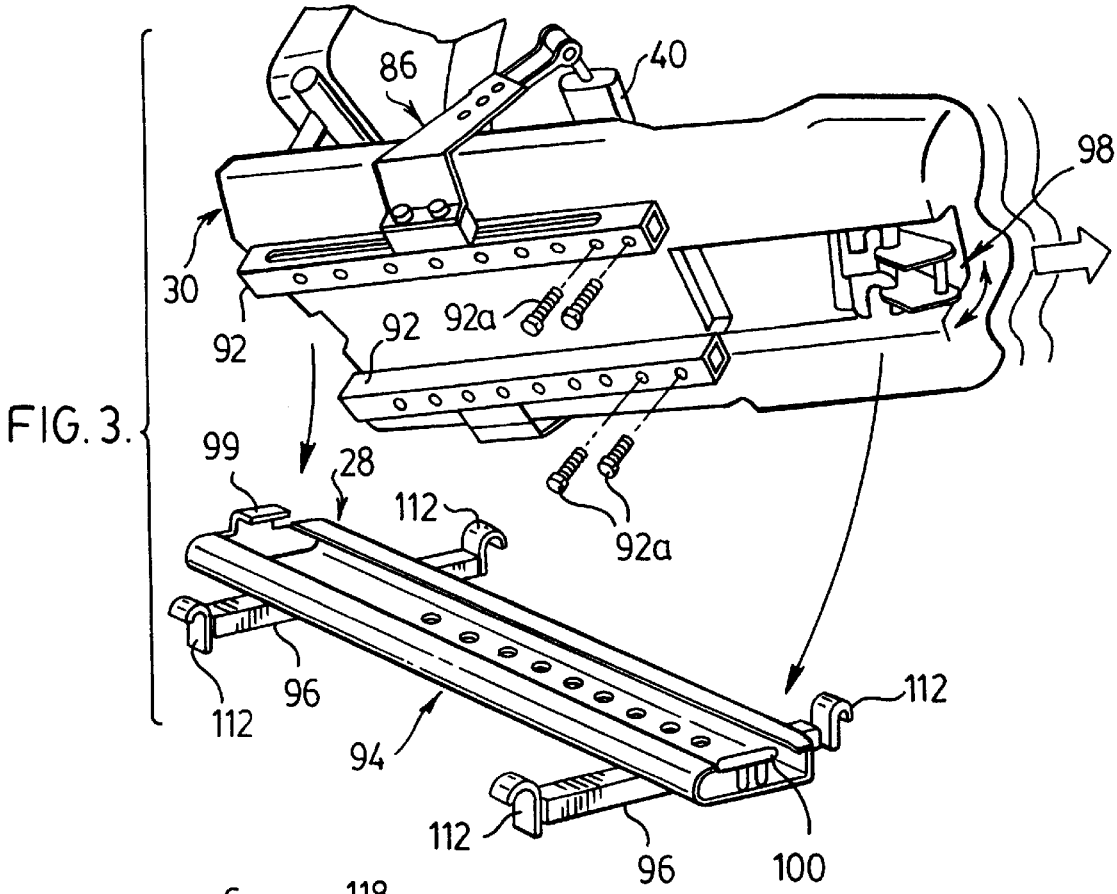
FIG. 3 is a perspective view showing the seat exploded above its support base.

Referring first to FIG. 1, a seat structure in accordance with the MPS system is generally denoted by reference numeral 20 and is shown in a partially exploded position above a wheelchair base 22. The wheelchair base is essentially conventional and includes a structural frame 24 that is supported on a pair of wheels 26 by which a user can propel the wheelchair base. The wheelchair base has not been shown in full since it is entirely conventional; it will include, for example, front wheels and a footrest. For present purposes, it is sufficient to note that the frame is provided with a so-called drop base 28 that extends longitudinally and centrally of the frame and by which the seat 20 can be removably coupled to the wheelchair base, while being longitudinally positioned with respect to the base. Particulars of the coupling arrangement are best shown in FIG. 3 and will be described later.

With continued reference to FIG. 1, seat 20 includes a contoured seat platform 30 comprising a rear section 30*a* and a distal (front) section 30*b*. In this embodiment, the two sections are made in one piece but they could be separate sections that are longitudinally adjustable with respect to one another.

Figure 2:
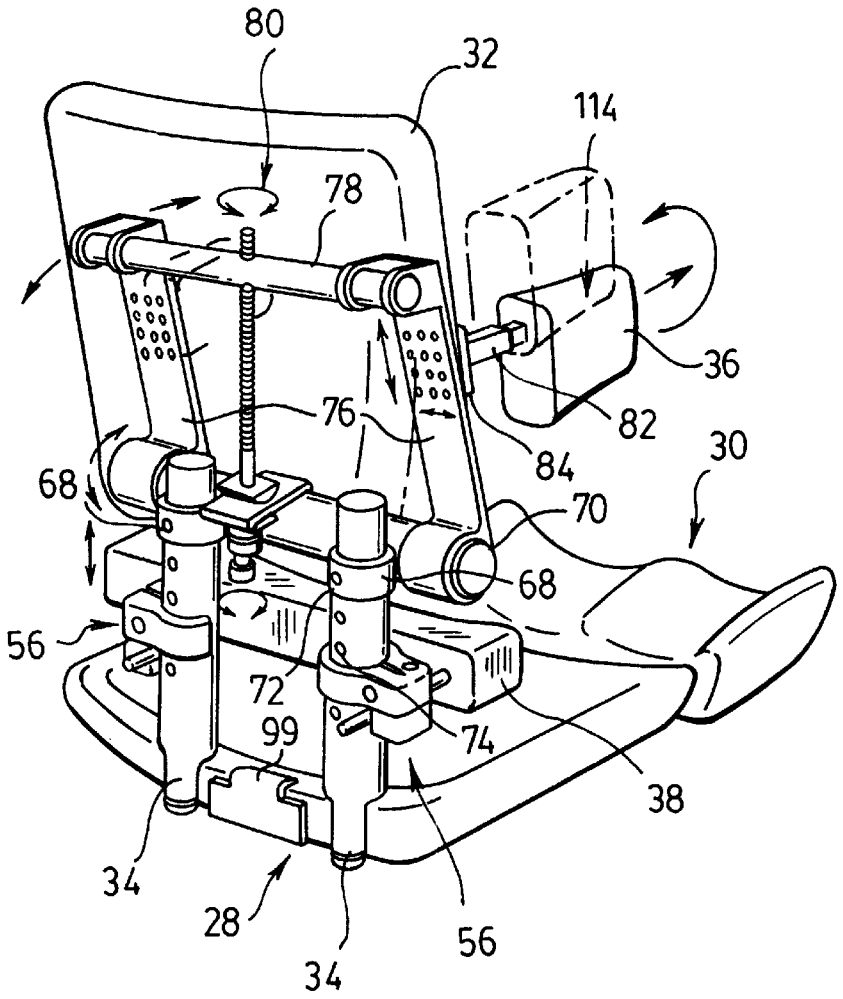
FIG. 2 is a rear perspective view of the seat of the system of FIG. 1 and includes a detail view denoted 2(*a*)
Figure 2A:
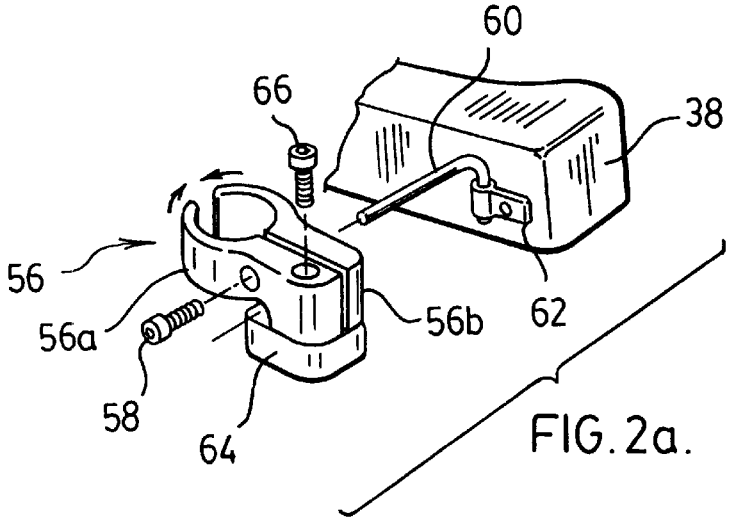

A reclining back 32 is supported at the rear of the seat platform 30 by a pair of support columns 34 which are seen in detail in FIG. 2. A pair of lateral pads 36 extend forwardly from opposite sides of the back 32. For convenience of illustration, supports for the pads 36 are not visible in FIG. 1 but are shown in more detail in FIG. 2.

Between the back 32 and the seat platform 30 is a short pad 38 that provides resistance to the posterior superior iliac spine (PSIS) of the pelvis.

Supported at opposite sides of the rear portion 30*a* of the seat platform 30 are a pair of so-called APS (Anterior Pelvic Stabilizer) pads 40. The pads can be positioned beneath the anterior superior iliac spine (ASIS) at the pelvic crease, and in proximity to the upper thigh to control the pelvis of a child seated on the seat in the anterior direction.

The MPS system has many unique features that differentiate it from other commercial wheelchair systems and that will now be described in more detail.

1. Pelvic Stabilization Components

MPS system has features that allow it to stabilize the child's pelvis. It does this by allowing elements of the system to be moved incrementally, then locked in place. Specifically, this is accomplished by adjusting the spatial relationship of three independent components: an ischial shelf 42 at the front edge of the rear portion 30*a* of seat platform 30; the PSIS pad 38, which supports the posterior superior iliac spine; and the two APS pads 40, which are positioned beneath the anterior superior iliac spine in firm contact with the upper thighs (Anterior Pelvic Stabilizer (APS) pads).

Figure 6A:
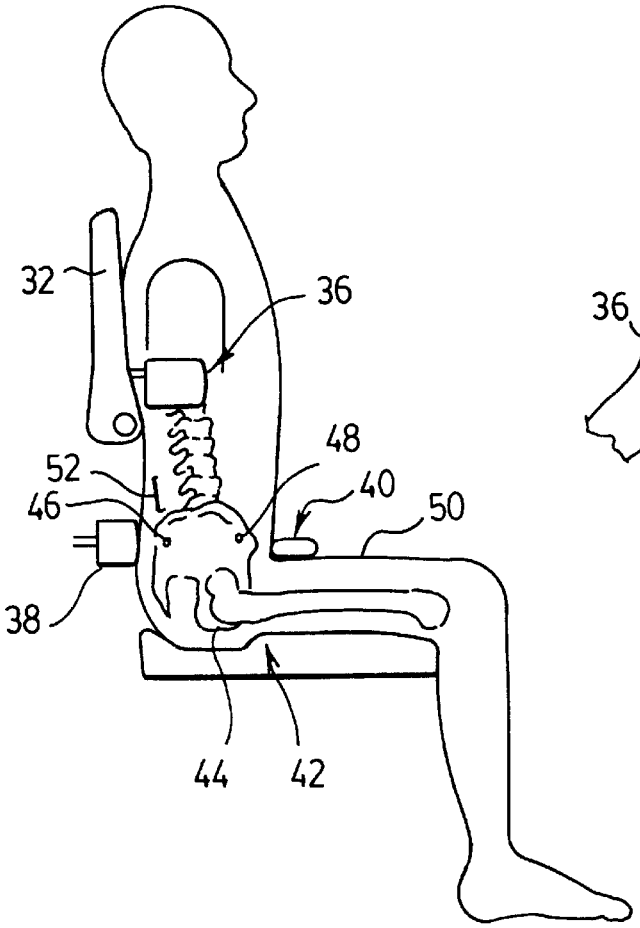
FIG. 6 comprises side and front elevational views (a) and (b) respectively that illustrate the manner in which the components of the seating system shown in previous views co-operate with parts of the pelvis and trunk of a person using the seating system, to provide proper postural support.
Figure 6B:
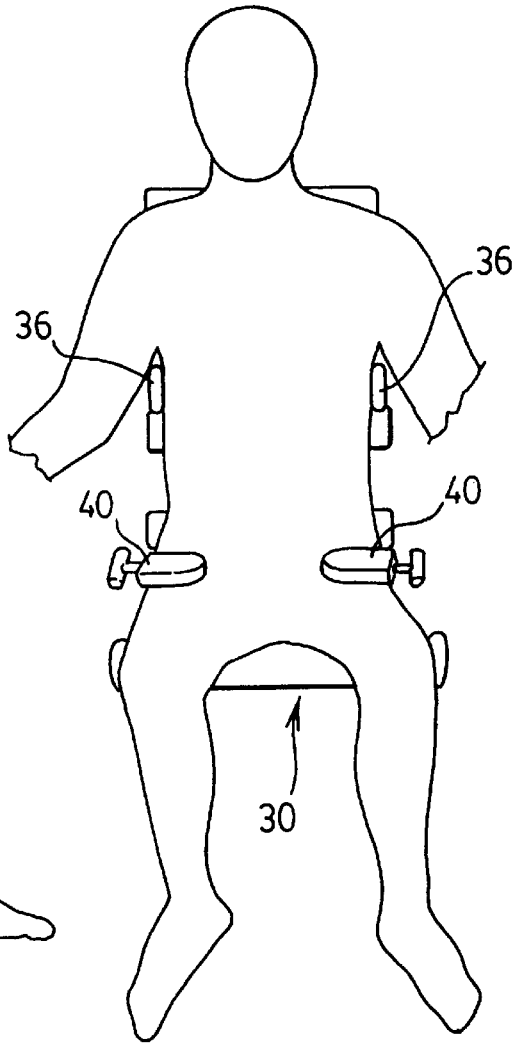

FIG. 6 shows in schematic form these pelvic stabilization components in conjunction with the pelvis and trunk of a person using the seating system. The ischial shelf 42 is shown forwardly of the ischial tuberosity 44 of the pelvis 46, the PSIS pad 38 is shown rearwardly of and adjacent the posterior superior iliac spine 46, and the APS pads 40 are shown beneath the anterior superior iliac spine 48 in light contact with or slightly elevated above the upper thighs 50.

Also shown in FIG. 6 are the lumbar vertebrae 52 of the spine, the reclining back 32 of the seat, and the lateral pads 36. It can be seen from FIG. 6 that the lateral pads 36 are adjusted to fit relatively closely adjacent opposite sides of the upper body of a person using the seating system, generally in the vicinity of the axillas.

Reference will now be made in more detail to the specific pelvic stabilization components discussed above:

(i) Ischial Shelf. This provides a constant-height, stepped barrier that extends across the width of the seat (FIG. 1). The ischial shelf forms a transition surface between the lower rear portion 30*a* and raised upper front portion 30*b* of the seat platform 30. This seat elevation change creates a "bucketed " area 54 for a seat cushion and helps to control rotation of the pelvis beneath the child. The ischial shelf 42 acts to keep the pelvis in a neutral position by preventing the ischial tuberosities 44 (FIG. 6) from migrating forward. The ischial shelf location can be customized by slidably moving the back relative to the seat platform. This location could be further tuned for the child by adding firm foam padding at the leading edge of the foam cushion, inside the seat's upholstery.

(ii) PSIS Pad 38. As noted previously, pad 38 is a short pad that provides resistance to the posterior superior iliac spine (PSIS) 46 (FIG. 6) of the pelvis. The PSIS pad 38 can be adjusted upwards, downwards and parallel to the long axis of the seat. These movements are achieved independently, by means of the mechanism is best illustrated in FIG. 2 (to be described). Pad 38 assists in posterior stabilization of the pelvis and in combination with the upper back section, promoting a lumbar lordosis of the spine.

FIG. 2 is a rear perspective view of the seat shown in FIG. 1. The two columns 34 referred to previously extend upwardly in parallel positions from the rear of the seat platform 30 and carry both the PSIS pads 38 and the reclining back 32.

PSIS pad 38 is clamped to the two columns 34 by respective brackets 56, one of which is shown in detail in an exploded perspective view 2(*a*). It will be seen that the bracket comprises two components 56*a*, 56*b* that are designed to embrace the relevant column and that can be tightened to clamp onto the column by a clamp screw 58. Extending through the bracket 56 is one limb of an angled arm 60, the other limb of which is pivotally coupled at its outer end to the PSIS pad 38, as indicated at 62. The other limb extends beneath the clamp components 56*a*, 56*b* and can be clamped against those components in an adjusted position by a clamping element 64, by means of a bolt 66 that extends through element 56*a*.

Upwardly of the clamps 56, the back 32 is coupled to the columns 34 by respective collars 68 that are carried by a horizontal bar 70 at the bottom edge of the back 32. Each collar 68 is slidable vertically on the relevant column 34 and can be secured in an adjusted position by a bolt (not shown) that extends through an opening 72 in the collar and one of a series of corresponding openings 74 in the column.

At each end, bar 70 carries a pair of uprights 76 that extend to an upper horizontal bar 78 parallel to bar 70. A screw mechanism 80 is provided for adjusting the angulation of the bar 78 and uprights 76 about the bar 70 to allow for spinal extension adjustment of the back.

The two lateral pads 36 are carried by respective arms that extend forwardly from the two uprights 76. One of those arms is shown in detail at 82 in FIG. 2. At its inner end, the arm 82 is carried by a plate 84 that has an array of openings that match with openings in the upright 76 so that the pad can be positioned in a selected one of a number of adjusted positions with respect to the back 32.

(iii) APS pad 40. Two symmetrical, semi-elliptical pads 40 (FIG. 1) are each suspended above the seat and back surfaces by a cantilevered, swing-away mechanism 86 called the Anterior Pelvic Stabilizer (APS). The APS pads 40, through slide adjustments, can be positioned beneath the anterior superior iliac spine (ASIS) 48 (FIG. 6) at the pelvic crease, and in proximity to the upper thigh 50, to control the child's pelvis anteriorly.

Each of the two APS structures 86 is anchored to one of two square tubular members 92 beneath the seat platform 30. The structures 86 are independently adjustable along the seat's length by being removably connected to the tubular members 92 (see FIG. 3*a*—to be described). As best seen in FIGS. 4 and 5, a circular shaft 88 connects each pad 40 to the APS mechanism, allows the pad to slide along the length of the shaft for incremental, individualized placement and permits free rotation of the pad along the shaft. The APS mechanism has a spring-loaded, disengagement plunger 93 that unlocks the shaft to allow the pad to pivot unhindered. The plunger 93 locks the shaft at 90 degree increments but can be disengaged by depressing the plunger and rotating the pads 40. This feature is necessary to allow the child to move unobstructed onto or out of the seat assembly and is shown in detail in FIG. 5*a*—to be described.

In an alternative embodiment, the two APS pads could be replaced by a single bar or pelvic belt.

2. Adjustable Upper Back

Back 32 provides upper body support from above the lumbar area of the back to the upper shoulder area of the child. To allow for growth and individualized placement, the back can be moved along the columns 34 that are anchored to the base of the seat. Additionally, the structure framework of the screw mechanism 80 allows for spinal extension adjustment. The upper back support works in conjunction with the PSIS pad 38 to promote spinal extension and lumbar lordosis.

3. Adjustable Seat

To provide seat depth adjustment, the seat platform 30 is removably connected to the pair of square tubular members 92 by bolts 92*a* that can be threaded into selected ones of a series of threaded openings that extend longitudinally of the bottom surface of platform 30. The two back support columns 34 are carried by the respective members 92. The pair of tubular members 92 extend parallel to one another longitudinally of the bottom of the seat platform 30 and fit over a complimentary channel member 94 that is secured to the wheelchair base 24 by a pair of transverse brackets 96.

At the front end of the seat is a spring-loaded latch mechanism 98 that automatically engages and locks to a cross-bar 100 of the drop base 28. The seat is removable from the drop base by disengaging the latch mechanism 98, lifting the seat assembly about a rear attachment flange 99 and raising it off of the drop base channel. Although previous designs have used latching mechanisms to allow quick release of a seat from a wheelchair, this design is unique in the way that it is combined with an adjustable seat depth.

It is envisaged that this mechanism can be used to allow caregivers to removably connect the seat assembly to other special purpose bases such as floor-sitters, high chairs and wagons.

4. Cushioning

Figure 7:
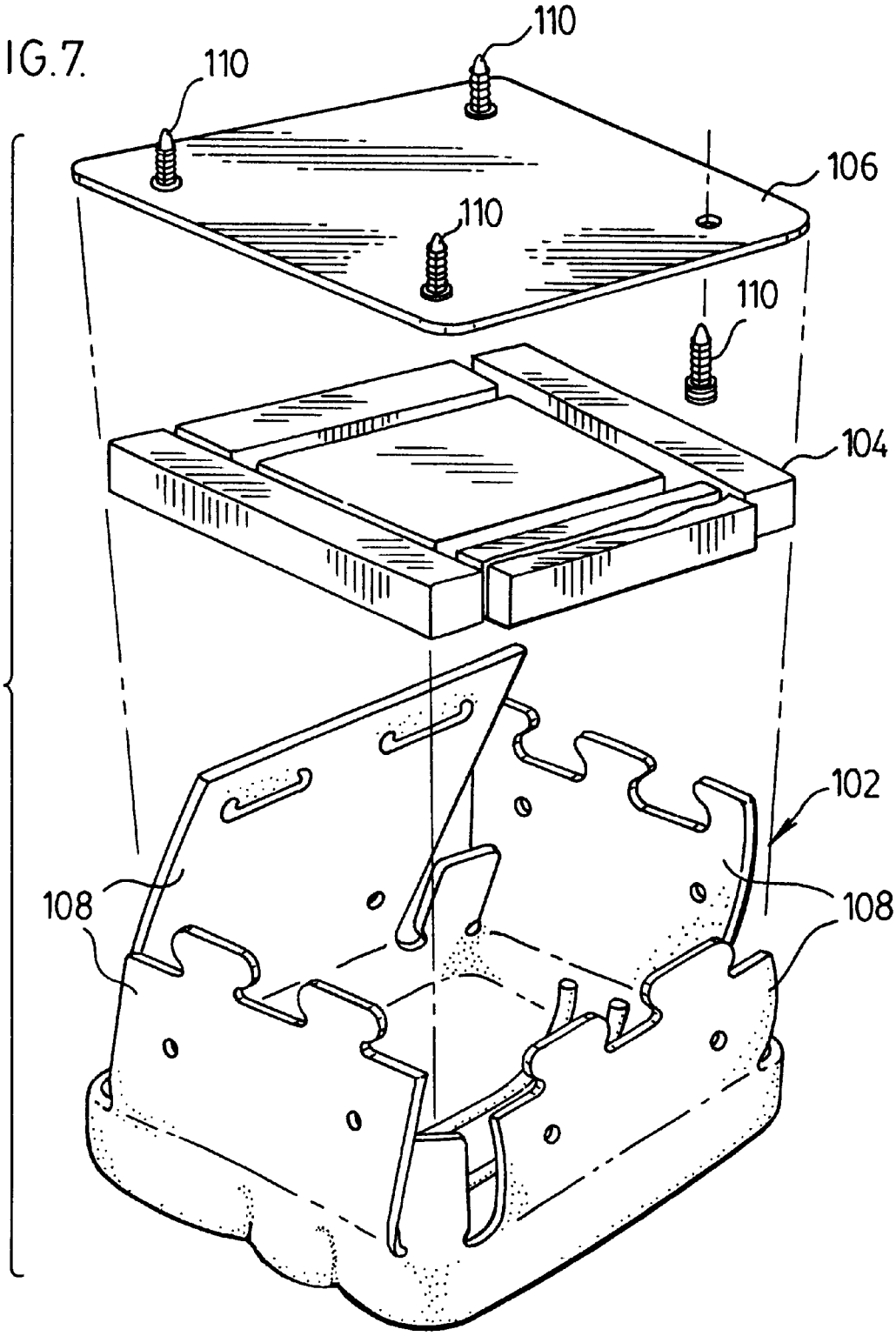
FIG. 7 is an exploded perspective view showing a seat cushion for the seating system; and, FIG. 8 comprises perspective views denoted (a) and (b) that illustrate how the seat cushion is assembled and installed.
Figure 8A:
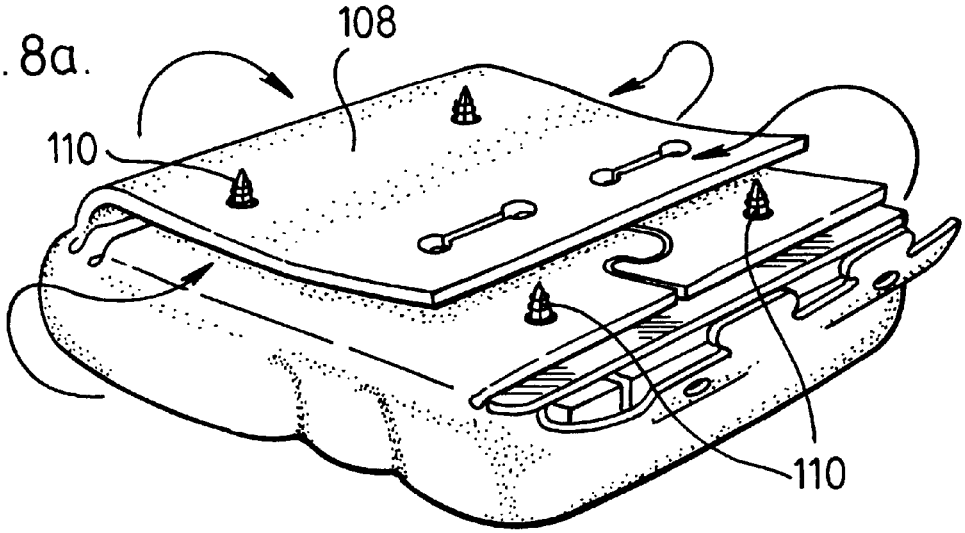
Figure 8B:
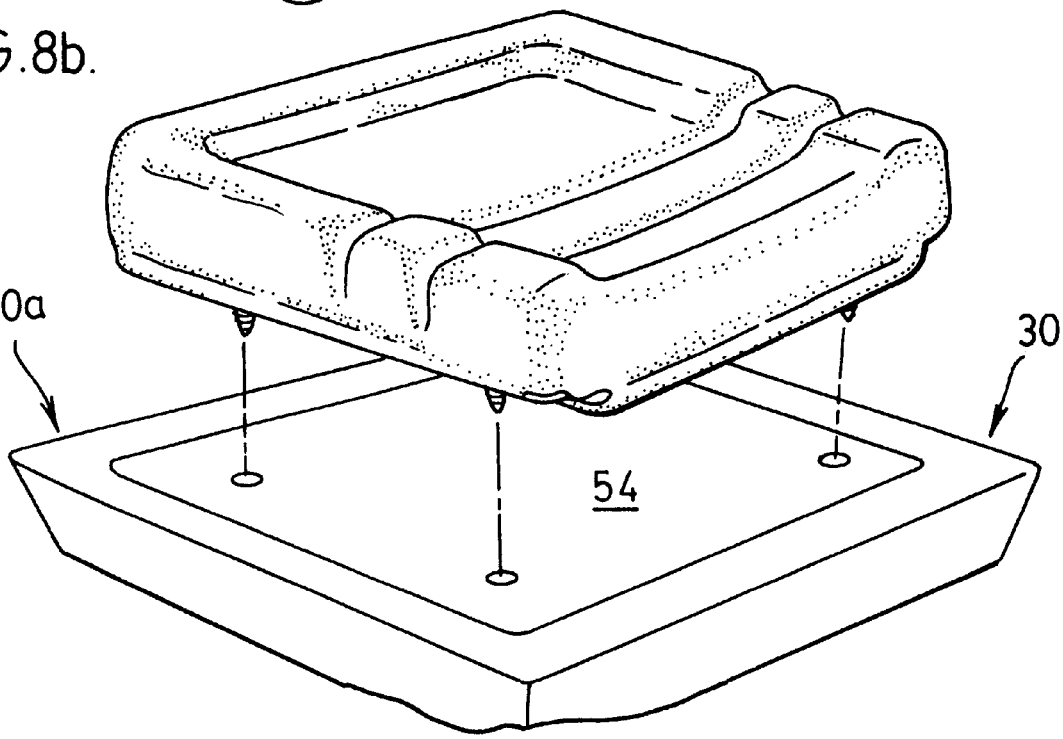

The seat platform 30, upper back 32 and PSIS 38 have firm contoured pads with upholstery covers that are removable. Extra support can be provided through the addition of foam padding inside the upholstery cover. A preferred embodiment of the seat cushion concept is shown in FIGS. 7 and 8. A moulded foam box 102 (FIG. 7) contains a combination of foam padding 104 to personalize the support provided to the user. A flexible plastic base plate 106 supports the foam padding and mounting clips, while formed sides and closure flaps 108 of the box contain the padding and base plate. In this embodiment, mounting clips 110 are used to secure the seat cushion onto the contoured seat platform 30 (FIG. 1). Usually, recontouring of the cushion and the introduction of different densities of foam padding would be done on an individualized basis. Seat cushioning is provided on the rear portion beneath the buttocks of the child. FIG. 8(*a*) shows the seat cushion assembled, while FIG. 8(*b*) shows the assembled cushion inverted preparatory to installation on seat platform 30.

5. Wheelchair Drop Base

The drop base 28 (FIGS. 1 and 3) provides the structural connection to and special placement of the seat assembly on the wheelchair base 22. Further, it is reconfigurable to avoid obstructive components of commercial wheelchairs including cross bars and wheel lock brackets. Two square, tubular cross-members 96 (FIG. 3) are removably connected to channel 94 to form the main structure of the drop base. Each of four height-adjustable, drop hooks 112 is located at the end of each cross member 96 to connect the drop base to the wheelchair rails at four points. Screw attachments (not shown) allow the drop hook to be relocated to adapt to the wheelchair's width. Further, the drop hooks can be height adjusted in pairs to provide a settable, rearward tilt to the seat assembly.

6. Trunk Laterals

The lateral pads 36 are provided to support the upper trunk of the child. Each of two symmetrical, semi-elliptical lateral pads are removably mounted to the upper back via a lateral bracket mechanism. Each lateral pad can be independently connected to the back to locate it below each axilla of the child.

To accommodate variations in clothing bulk (especially, between winter and summer or outdoor and indoor wear), a spring-mounted mechanism 114 (FIG. 2) is provided to allow relocation of the lateral pad, either lower and outward or higher and inward. This is achieved by pulling the lateral pad out of the bracket housing of the lateral pad bracket, rotating it 180 degrees about the attachment axis and relocating it in the housing. This action is resisted and assisted by a spring mechanism (not shown) located in the bracket housing.

Figure 3A:
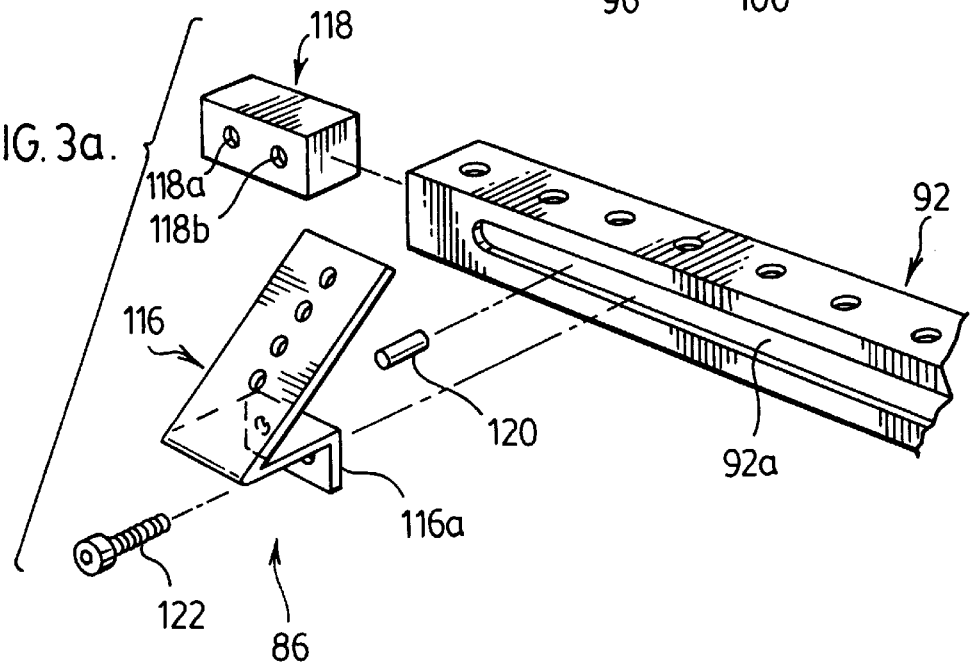
FIG. 3*a* is an exploded perspective view illustrating a detail of FIG. 3.

Reference will finally be made to FIGS. 3*a* and 5*a* in describing details of the specific APS structures shown in other views.

Each APS pad 40 consists primarily of a rigid semi-elliptical shaped casting 40*a* (e.g. of polyurethane) with a firm layer of a closed-cell foam 40*b* laminated along its perimeter. The foam perimeter 40*b* of the APS pad 40 contacts the user below the ASIS and the casting 40*a* serves to resist forward movement of the pelvis of the user.

Referring to FIGS. 4 and 5, it will be recalled that each of the APS pads 40 is carried by a shaft 88 that is supported by an APS mechanism 86. Each mechanism 86 includes an upper bracket 114 (FIG. 5*a*) and a lower bracket 116 (FIG. 3*a*) which are telescopically adjustable with respect to one another and can be secured in an adjusted position by nuts and bolts (not shown). The lower bracket 116 has a bottom end portion that is directed laterally and then downwardly, defining a flange 116*a* that abuts against one side of the relevant tubular member 92 at the bottom of the seat platform 30 (FIG. 3). A block 118 is slidably received in tubular member 92 inwardly of a longitudinally extending slot 92*a* in the member. Block 118 is retained within the member by a C-section spring retaining pin 120 that extends through slot 92*a* and into a plain opening 118*a* in block 118. Pin 120 extends outwardly of slot 92*a* and into a corresponding opening in flange 116*a*. A bolt 122 extends through an adjacent opening in flange 116*a* and is threaded into an opening 118*b* in block 118 so that, by tightening bolt 122, bracket 116 (mechanism 86) can be locked in an adjusted position longitudinally of tubular member 92.

Referring to FIG. 5*a*, bracket 114 has a pair of parallel generally circular formations 114*a*, having respective square openings 114*b*. A button pivot detent assembly 122 has a square centre section 123 that is dimensioned to fit relatively closely through the openings 114*b*. However, the centre section has a length less than the spacing between the two portions 114*a* of bracket 114 so that the centre section fits within only one of the two openings 114*b* at any one time.

In the assembled mechanism, the assembly 122 fits within a rectangular passageway through a drum 124 that also fits between the two portions 114*a* of bracket 114. The drum 124 and assembly 122 have matching openings 124*a,* 122*a* through which the shaft 88 of pad 40 can extend. Shaft 88 has a circumferential groove 88*a* at its lower end for receiving a circlip 124.

Finally, assembly 122 has a longitudinal bore 126 that receives a spring 128 and a button 130. The far end of the bore 126 as seen in FIG. 5*a* is closed. In assembling the mechanism 86, the spring 128 and button 130 are inserted past the opening 122*a* that receives shaft 88 of pad 40. The shaft is then inserted so that the spring 128 causes button 130 to bear against the shaft and bias assembly 122 to the right as seen in FIG. 5*a,* effectively locking the shaft 88 and pad 40 in the upright position shown. However, the mechanism can be released by depressing assembly 122 against the action of spring 128 to an extent sufficient to cause the square centre section 122*a* to clear the relevant opening 114*b*. The assembly, together with the pad 40 can then be turned to adjusted angular positions at right angles with respect to one another.

It is of course to be understood that this particular mechanism is given by way of example only and without limitation.

It should again be noted that the invention is applicable more broadly than to paediatric seating systems and may be used, for example, for adult seating systems, for example wheelchairs, or in other applications that require precise upper body control during conditions that may hamper stability of a seating posture.

What is claimed is:

1. An adjustable seating system which includes at least a seat and a back and which is adaptable to provide specialized postural control for a person using the seating system by supporting specific anatomical areas of that person, wherein the seating system includes first, second and third pelvic stabilization components, comprising:

(1) a raised barrier that extends transversely of the seat at a distance spaced forwardly of a rear end of the seat for co-operation with the ischial tuberosities of the pelvis, to control rotation of the pelvis beneath the person;

(2) a pad extending transversely of the back at a location to provide resistance to the posterior superior iliac spine of the pelvis; and, (3) means extending transversely of and spaced above the seat in the vicinity of the upper thigh area of the person for controlling anterior movement of the pelvis, said means comprising two semi-elliptical pads that are suspended above the seat and forwardly of the back by a cantilever mechanism that allows the pads to be moved between operative positions in which they contact the pelvic area of a seated person from opposite sides, and inoperative positions in which the pads are retracted to allow the person to enter and leave the seat; wherein the cantilever mechanism comprises respective brackets at each side of the seat, the brackets being coupled to the seat for adjustment longitudinally thereof and being adjustable height-wise with respect to the seat; a pair of shafts each supporting a said pad for adjustable sliding movement longitudinally of the shaft and turning movement about the shaft; and means coupling the shafts, to the respective brackets for turning between respective generally upright positions and generally horizontal positions corresponding respectively to said inoperative positions and operative positions of the pads.

2. A seating system as claimed in claim 1, which includes means to extend the seat depth thereby accommodating various thigh lengths, wherein said means comprise of a bi-level seat structurally supported by two parallel channel sections beneath the seat.

3. A seating system as claimed in claim 1, which includes rotational means along the perimeter of the back for adjusting its recline to support the person's upper back, wherein said means comprise of a threaded rod free to rotate at one end and supported by a internally-threaded member at the opposite end allowing adjustment of the angular orientation of the back about an axis at or near the opposite end.

4. A seating system as claimed in claim 1, which includes means extending forwardly of the back for controlling the lateral movement of the trunk below the axilla of the person, wherein said means comprise two symmetrical pads located by spring-loaded engagement of a rod and flanged tube, allowing pads to be displaced readily to accommodate clothing bulk.

5. A seating system as claimed in claim 1, which includes means to connect the seat and back to a wheeled or other base, wherein said means includes a spring-loaded latch means on the seat portion and a cross-wire and hook arrangement on the base portion, allowing ready engagement and disengagement of the seat system and base.

6. A seating system as claimed in claim 1, which includes a cushioning means to customize the postural support provided, said means comprising a closed foam box, combination of foam padding and a base plate that, when appropriately packaged and connected to the seat platform, form the cushion interface for the person.

7. A seating system as claimed in claim 1, wherein said pad extending transversely of the back at a location to provide resistance to the posterior superior iliac spine of the pelvis is coupled to the seat by coupling-means-comprising a pair of columns that extend upwardly from the seat generally parallel to one another rearwardly of the pad; respective brackets each embracing one of the columns and adapted to be clamped to the column in an adjusted angular position; and respective arms extending outwardly from said brackets and pivotally coupled at outer ends thereof to said pad.

8. A seating system which includes at least a seat and a back, and means extending transversely of and spaced above the seat in the vicinity of the upper thigh area of the person for controlling anterior movement of the pelvis, said means comprising two semi-elliptical pads that are suspended above the seat and forwardly of the back by a cantilever mechanism that allows the pads to be moved between operative positions in which they contact the pelvic area of a seated person from opposite sides, and inoperative positions in which the pads are retracted to allow the person to enter and leave the seat; wherein the cantilever mechanism comprises respective brackets each side of the seat, the brackets being coupled to the seat for adjustment longitudinally thereof and being adjustable height-wise with respect to the seat; a pair of shafts each supporting a said pad for adjustable sliding movement longitudinally of the shaft and turning movement about the shaft; and means coupling the shafts to the respective brackets for turning between respective generally upright positions and generally horizontal positions corresponding respectively to said inoperative positions and operative positions of the pads.

* * * * *